United States Patent [19]

Andreasson

[11] Patent Number: 4,653,189

[45] Date of Patent: Mar. 31, 1987

[54] ARRANGEMENT IN A MOTOR SAW

[75] Inventor: Bo C. Andreasson, Gothenburg, Sweden

[73] Assignee: AB Electrolux, Stockholm, Sweden

[21] Appl. No.: 745,218

[22] Filed: Jun. 17, 1985

[30] Foreign Application Priority Data

Jun. 19, 1984 [SE] Sweden ..... 8403281

[51] Int. Cl.[4] ..... B27G 19/00

[52] U.S. Cl. ..... 30/382; 123/198 DC; 123/417; 30/381; 83/DIG. 1

[58] Field of Search ..... 30/381, 382; 123/198 D, 123/198 DC, 417; 188/171, 158, 159, 160; 83/1; 364/475; 307/326; 361/33

[56] References Cited

U.S. PATENT DOCUMENTS

| | | | |
|---|---|---|---|
| 3,964,461 | 6/1976 | Wesemeyer et al. | 123/198 DC |
| 4,152,833 | 5/1979 | Phillips | 30/382 |
| 4,553,517 | 11/1985 | Andreasson | 123/417 |

*Primary Examiner*—Donald R. Schran
*Assistant Examiner*—James L. Wolfe
*Attorney, Agent, or Firm*—Alfred E. Miller

[57] ABSTRACT

An electro-mechanical brake in a motor saw requires electric energy for the operation of the brake. This energy can, according to the invention, be surplus energy in the ignition system of the saw. Surplus energy exists usually only when the r.p.m. exceeds a certain value. A capacitor is charged by current from the system and is prepared to discharge through a coil to actuate the brake on a signal from a kickback sensor.

3 Claims, 3 Drawing Figures

ARRANGEMENT IN A MOTOR SAW

FIELD OF THE INVENTION

The present invention relates to an arrangement for actuating a chain brake in a power chain saw which during operation for instance, while debranching, has a tendency to generate a kick-back in which the saw is thrown against the operator.

DESCRIPTION OF RELATED ART

It is previously known to provide a chain brake in motor saws with an accompanying triggering mechanism so that the saw chain is stopped at an early stage of such a kick-back. In mechanical triggering devices parts are occasionally subjected to pollution, chips etc. which can make the device inoperative. Apparently, it is therefore desireable to introduce a completely electrical triggering device without movable parts.

Since a motor saw does not have any battery all energy for actuating the brake must be generated by the engine in duty. From previous patent specifications, e.g. SE—A 8205901-5, the principle is known of using negative pulses from a magnet ignition system for supplying an electronic ignition device with a micro-processor.

SUMMARY OF THE INVENTION

Briefly stated, in accordance with the invention, since a micro-processor is employed in the ignition device, it is possible to control the functions of an actuating device for the brake so that the charging of the device takes place in only a determined range of r.p.m., as well as to actuate the brake in response to a suddenly occurring decrease of the r.p.m. The brake actuating device may be comprised of an electromagnet, energized by the current from a capacitor. In accordance with the invention, the capacitor is charged under the control of the micro-processor, only when the r.p.m. of the engine is sufficiently high that surplus energy is available for the charging.

BRIEF FIGURE DESCRIPTION

An embodiment of a releasing device according to the invention will be described in the following with reference to the accompanying drawings which show in FIG. 1 a block diagram of the actuating device, FIG. 2 a couple of graphs for explaining the device according to FIG. 1, FIG. 3 an ignition system with a micro-processor and an operating circuit for a chain brake.

DESCRIPTION OF PREFERRED EMBODIMENT

Figure 1:
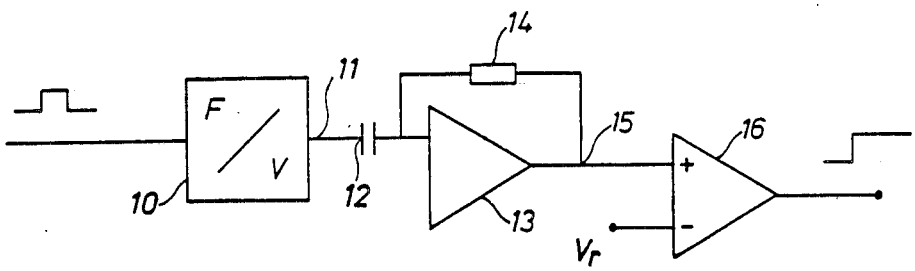
Figure 2:
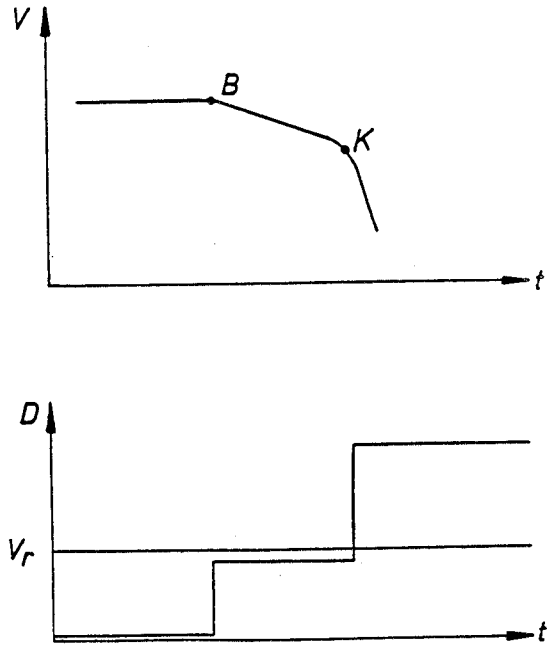

FIG. 1 shows how the electrical wiring of the device, in principle, can be carried out. Electric pulses from the electric system of the motor saw (the ignition system or the like) are fed to a frequency-voltage converter 10 supplying on its output 11 a voltage V which is related to the frequency of the pulses. Since the pulse frequency is proportional or equal to the r.p.m. the voltage obtained immediately follows the variations of the r.p.m. The output 11 is via a capacitor 12 connected to an operational amplifier 13 in the form of a derivative circuit and shunted by a resistor 14. The output 15 of the circuit is then a voltage which is an inverted derivative D of the voltage V. In FIG. 2 it is shown that D is 0 when V is constant, and by a minor decrease of r.p.m. at B (at decreasing V) D shows a moderate positive value. Such a decrease comes about when the saw is subjected to a normal loading. A greater and more rapid decrease occurs at K as a consequence of a kick-back. The derivative is suddenly changed into a greater value. The derivative voltage is fed to a comparator 16 which also receives a reference voltage Vr. When this voltage is exceeded by the derivative voltage the comparator emits an output signal starting that a kick-back is going on.

Figure 3:
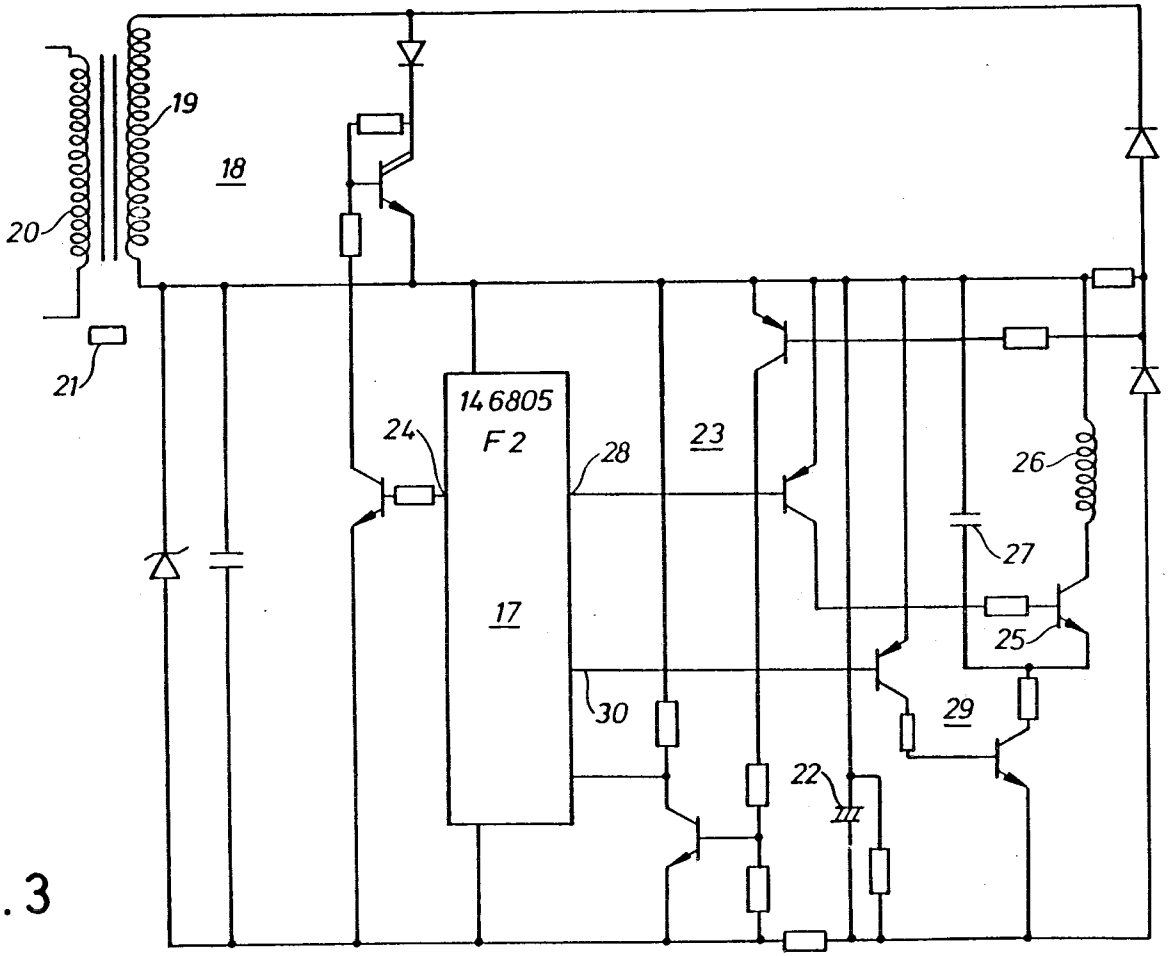

In FIG. 3 an ignition system is schematically shown provided with an actuating device built-in in a micro-processor 17 which is included in the electric system of the motor saw, mainly the ignition system. The processor has a built-in timer which measures the time of a revolution of the engine shaft by means of reference times on a voltage curve induced by an ignition generator 18. This generator has as usual a couple of windings 19, 20 and a magnet 21 positioned in a flywheel. The current supply to the electronic circuits is obtained during the negative half-periods of the primary voltage from the winding 19, whereby a capacitor 22 is charged to an operating voltage. A transistor amplifier 23 is used to feed pulses at the reference time on the voltage curve, which time occurs in this case 0.6 V before zero on the ascending part of the curve. The pulse is fed to the processor as a start signal of a procedure according to the following.

The input to which a signal is supplied is scanned and the time is stored as a reference time. The storing is possible since the micro-processor has a timer running at a fixed frequency. At every reference time a number of time pulses occurring after the preceding reference time are registered. The number of pulses corresponds to a rotation of 360° of the crankshaft. By dividing the number of pulses between the reference times by a predetermined number, e.g. 16, a number remains which corresponds to an ignition advance of 360/16=22.5°. This number is called the reference number and is a memory data stored in a static memory of the processor. The reference number can be dependent on the r.p.m. and is at low r.p.m. inversely proportional. When the number of time pulses reaches the said reference number the ignition is initiated via an output 24 on the processor. The timer is set to zero every time a reference time passes and the counting to the reference number takes place for every spark. At higher r.p.m. the reference number is so dependent on the r.p.m. that it gives one for the actual engine suitable ignition characteristica.

The special part of the device related to the actuation of the chain brake includes the transistor 25, an electromagnet coil 26 and a capacitor 27. The base of the transistor is connected to an output 28 of the processor which supplies a signal derived from a timer and memory circuits in the processor. The transistor closes the circuit so that a current will pass from the capacitor 27 through the coil 26. The electromagnet controls a latch arrangement of the chain brake which then permits tightening of the brake. The signal arises by measuring the time of revolution T by means of the timer which time from one revolution to the other is extended when a kick-back occurs. The condition for a brake actuation that $$T_n - T_{n-1} > A$$

where $T_n$ is the time of the $n^{th}$ revolution, $T_{n-1}$ is the time of the foregoing revolution. A is a reference number which is proportional to the revolution, for instance $T_n/8$. To determine A for every type of motor saw is a practical job in which it is necessary to measure the time of revolution at the occasion of a kick-back and at a time point before such an occasion and to compute the time extension. The computation belongs to the ordinary use of a processor, and as an example it is given a standard number on the drawing on such a suitable processor.

The problem of charging the capacitor 27 is solved by a special charging circuit as shown in FIG. 3. The capacitor is supplied from the same source as other electronic components, namely the negative half-periods of the ignition generator, i.e. the surplus of energy remaining after that the electronic components are supplied. However, it is not possible to use the negative half-periods for charging already at the start, since the electronic components need all available energy during the start procedure. In the invention this problem is solved in that an r.p.m. responsive switch switches the charging circuit to the capacitor 27 first when the engine has reached a predetermined r.p.m., e.g. 3000 r.p.m. The switch can here be a transistor amplifier 29 connected to an output 30 of the processor, where the signal appears when the r.p.m. is about 3000, thereby charging the capacitor via a resistor 31. The signal arises in a register recording an r.p.m.-range > 3000 r.p.m. The register is supplied with output code from the timer of the processor which during every revolution of the engine shaft counts up to a code which can be translated into r.p.m. of the engine. The register has the property of emitting the signal when it is supplied with a timer code corresponding to r.p.m. > 3000.

The devices now described shall be considered examples of embodiments of the invention which can be varied with conventional techniques without departing from the inventive idea. For instance, negative and positive half-periods of the generated voltage can alternatively be used for the component supply and the spark, respectively. Moreover, the description is based on a system with magnetically induced ignition voltage but the invention is, of course, also applicable on capacitor discharge systems.

I claim:

1. In a motor saw having an engine for driving a saw chain, an ignition system including an ignition generator for producing electric pulses at a rate responsive to the r.p.m. of the engine, a logic circuit for controlling the ignition of said engine, current supply means connected to the ignition generator to derive operating current for said logic circuit from said pulses, a chain brake for said saw including an electromagnet and a capacitor for storing a charge for energizing said electromagnet, said logic circuit including first switch means for discharging said capacitor through said electromagnet for operating said brake; the improvement wherein said logic circuit comprises second switch means connected to the logic circuit to charge said capacitor from said current supply means, and means for energizing said second switch means to charge said capacitor only when the r.p.m. of said engine exceeds a given r.p.m. greater than zero at which time surplus energy is present.

2. The motor saw of claim 1 wherein said logic circuit comprises a microprocessor connected to said first and second switch means to control said first and second switch means, and means applying said pulses to said microprocessor, whereby said microprocessor comprises means for controlling said second switch means to charge said capacitor only when the r.p.m. of said engine exceeds said given r.p.m.

3. The motor saw of claim 1 wherein said second switch means comprises a transistor provided with an emitter, said logic circuit being connected to the emitter of said transistor.

* * * * *